US007864252B2

(12) United States Patent
Takahashi et al.

(10) Patent No.: US 7,864,252 B2
(45) Date of Patent: Jan. 4, 2011

(54) VIDEO SIGNAL PROCESSOR CAPABLE OF SUPPRESSING EXCESSIVE HEAT GENERATION, METHOD USING THE SAME, DISPLAY DEVICE AND METHOD USING THE SAME

(75) Inventors: Satoshi Takahashi, Osaka (JP); Ryogo Yanagisawa, Osaka (JP); Toru Iwata, Osaka (JP)

(73) Assignee: Panasonic Corporation, Osaka (JP)

( * ) Notice: Subject to any disclaimer, the term of this patent is extended or adjusted under 35 U.S.C. 154(b) by 1321 days.

(21) Appl. No.: 11/071,190

(22) Filed: Mar. 4, 2005

(65) Prior Publication Data

US 2005/0231493 A1 Oct. 20, 2005

(30) Foreign Application Priority Data

Mar. 31, 2004 (JP) ..... 2004-106776

(51) Int. Cl.
*H04N 5/63* (2006.01)
*H04N 17/00* (2006.01)
*H04N 5/44* (2006.01)
*H03L 7/00* (2006.01)

(52) U.S. Cl. ..... 348/739; 348/184; 348/553; 348/536

(58) Field of Classification Search ..... 348/184, 348/731, 730, 500, 553, 536, 537, 180; 455/343.1; 334/5; 713/300
See application file for complete search history.

(56) References Cited

U.S. PATENT DOCUMENTS 3,581,011 A * 5/1971 Ward et al. ..... 348/524
4,298,890 A * 11/1981 Lai et al. ..... 348/548
4,879,758 A * 11/1989 DeLuca et al. ..... 455/296
4,984,082 A * 1/1991 Okamura ..... 348/565
5,142,247 A * 8/1992 Lada et al. ..... 331/14
5,698,942 A * 12/1997 Greene et al. ..... 313/497
5,883,853 A * 3/1999 Zheng et al. ..... 365/233.1

(Continued)

FOREIGN PATENT DOCUMENTS

CN 1249612 A 4/2000

(Continued)

OTHER PUBLICATIONS

Chinese Office Action issues in corresponding Chinese Patent Application No. CN 200510059373.7, dated Dec. 1, 2006.

(Continued)

*Primary Examiner*—Victor Kostak
(74) *Attorney, Agent, or Firm*—McDermott Will & Emery LLP

(57) ABSTRACT

A video signal processor for processing input video data in accordance with an input clock signal includes: an input section for changing the format of the video data and outputting resultant data; a logic section for decoding the data output from the input section and outputting decoded data; and a frequency detector for detecting that the clock signal has a frequency higher than a given frequency and outputting a result of the detection as a detection signal. When the frequency of the clock signal is higher than the given frequency, operation of at least part of circuits constituting the video signal processor is stopped in accordance with the detection signal.

18 Claims, 7 Drawing Sheets

U.S. PATENT DOCUMENTS

| | | | | |
|---|---|---|---|---|
| 5,926,053 | A * | 7/1999 | McDermott et al. | 327/298 |
| 6,259,424 | B1 * | 7/2001 | Kurogane | 345/93 |
| 6,397,343 | B1 * | 5/2002 | Williams et al. | 713/501 |
| 6,693,628 | B1 * | 2/2004 | Hase et al. | 345/213 |
| 6,820,209 | B1 * | 11/2004 | Culbert et al. | 713/501 |
| 6,924,796 | B1 * | 8/2005 | Someya et al. | 345/213 |
| 6,977,677 | B1 | 12/2005 | Shinohara | |
| 7,126,595 | B2 * | 10/2006 | Yanagi et al. | 345/211 |
| 7,343,508 | B2 * | 3/2008 | Khodorkovsky | 713/500 |
| 2001/0036193 | A1 | 11/2001 | Kori | |
| 2002/0036636 | A1 * | 3/2002 | Yanagi et al. | 345/211 |
| 2002/0105592 | A1 * | 8/2002 | Felts et al. | 348/554 |
| 2002/0113892 | A1 | 8/2002 | Sakai et al. | |
| 2003/0226049 | A1 * | 12/2003 | Mantani | 713/322 |
| 2003/0229816 | A1 * | 12/2003 | Meynard | 713/600 |
| 2003/0233665 | A1 * | 12/2003 | Tsujino et al. | 725/134 |
| 2004/0027515 | A1 | 2/2004 | Itakura | |
| 2004/0103330 | A1 * | 5/2004 | Bonnett | 713/322 |
| 2005/0071705 | A1 * | 3/2005 | Bruno et al. | 713/500 |
| 2005/0149929 | A1 * | 7/2005 | Srinivasan et al. | 718/100 |

FOREIGN PATENT DOCUMENTS

| | | |
|---|---|---|
| JP | 06-003386 | 1/1994 |
| JP | 09-162726 | 6/1997 |
| JP | 10-198325 | 7/1998 |
| JP | 10-261958 | 9/1998 |
| JP | 2000-284764 | 10/2000 |
| JP | 2001-251385 | 9/2001 |
| JP | 2001-266313 | 9/2001 |
| JP | 2003-084722 | 3/2003 |
| JP | 2003-143499 | 5/2003 |
| JP | 2004-077506 | 3/2004 |

OTHER PUBLICATIONS

Japanese Notice of Reasons for Rejection, w/ English translation thereof, Issued in Japanese Patent Application No. JP 2004-106776 dated Apr. 27, 2010.

* cited by examiner

VIDEO SIGNAL PROCESSOR CAPABLE OF SUPPRESSING EXCESSIVE HEAT GENERATION, METHOD USING THE SAME, DISPLAY DEVICE AND METHOD USING THE SAME

CROSS-REFERENCE TO RELATED APPLICATION

The disclosure of Japanese Patent Application No. 2004-106776 filed on Mar. 31, 2004 including specification, drawings and claims is incorporated herein by reference in its entirety.

BACKGROUND OF THE INVENTION

The present invention relates to video signal processor for processing video data.

Standards for interfaces for use in transmitting video signals as digital data are known. Typical standards are the digital visual interface (DVI) and the high-definition multimedia interface (HDMI).

In these standards, multiple transmission rates are defined, and thus many devices receiving video data need to operate based on clocks with frequencies associated with the respective transmission rates of the video data.

An example of a PLL circuit which outputs clocks with frequencies associated with input signals is disclosed in Japanese Unexamined Patent Publication (Kokai) No. 10-261958. An example of a signal transmission device for transmitting signals using high-speed and low-speed serial buses is disclosed in Japanese Unexamined Patent Publication (Kokai) No. 2001-251385.

Devices receiving video data are not necessarily designed to process signals for all the transmission rates defined by the standards. For example, to avoid increase in cost, video signals with high transmission rates are left out of objects to be processed in some cases. However, a video signal with an unexpected-high transmission rate can be input without knowing that.

In a case where a video signal with a high transmission rate is input, a circuit tends to operate in accordance with a high-speed clock associated with the input signal. Accordingly, if a video signal higher than a speed predetermined in the design is input, the circuit malfunctions or excessive heat is generated. In particular, to release heat generated by the circuit, it is necessary to provide a heat sink or the like having sufficient ability. This causes another problem of increase in cost.

SUMMARY OF THE INVENTION

It is therefore an object of the present invention to prevent generation of excessive heat even when video data with an unexpectedly-high transmission rate is input.

Specifically, in a first aspect of the present invention, a video signal processor for processing input video data in accordance with an input clock signal includes: an input section for changing the format of the video data and outputting resultant data; a logic section for decoding the data output from the input section and outputting decoded data; and a frequency detector for detecting that the clock signal has a frequency higher than a given frequency and outputting a result of the detection as a detection signal. When the frequency of the clock signal is higher than the given frequency, operation of at least part of circuits constituting the video signal processor is stopped in accordance with the detection signal.

With this processor, when a video signal with a high transmission rate is input, operation of at least part of the circuits is stopped. Accordingly, it is possible to prevent circuits from operating at unexpectedly high frequencies, thus suppressing generation of excessive heat. As a result, adverse effects caused by heat are prevented.

The processor preferably further includes a low-speed clock generator for outputting a substantially-periodical signal, and the frequency detector preferably includes a frequency divider using the signal output from the low-speed clock generator as a reset signal, dividing the frequency of the clock signal and outputting a resultant signal as the detection signal.

The processor preferably further includes a low-speed clock generator for outputting a substantially-periodical signal, and the frequency detector preferably includes a shift circuit using the signal output from the low-speed clock generator as a reset signal and outputting, as the detection signal, a result obtained by shifting a signal at a given level in accordance with the clock signal.

In the processor, the frequency detector preferably includes: a frequency divider for dividing the frequency of the clock signal and outputting a resultant signal; and a central processing unit (CPU) for performing the detection based on an interval between changes in the level of the signal output from the frequency divider and outputting a result of the detection as the detection signal.

In the processor, the frequency detector preferably further includes a register for holding and outputting the output of the frequency divider, and the CPU preferably performs the detection using an output of the register.

In the processor, the input section and the logic section preferably include blocks associated with respective bits in the register, the frequency divider preferably outputs a plurality of signals obtained by dividing the frequency of the clock signal by different ratios, the register preferably stores the signals output from the frequency divider in respective different bits, and the CPU preferably controls operation of each of the blocks based on the value of an associated one of the bits in the register.

In the processor, the frequency detector preferably includes: an inverter for inverting the logic level of an input signal and producing an output; a first flip-flop for outputting the output of the inverter in synchronization with the clock signal; a delay circuit for delaying the output of the first flip-flop and outputting a delayed signal to the inverter; a second flip-flop for outputting the output of the first flip-flop in synchronization with the clock signal; and an exclusive-OR gate for obtaining an exclusive-OR of the output from the first and second flip-flops and outputting the obtained exclusive-OR as the detection signal.

In the processor, the input section preferably includes: a first input circuit operating at the frequency of the input video data; and a second circuit operating at the frequency of the clock signal, and the input section preferably stops the first circuit in accordance with the detection signal.

In the processor, the input section preferably stops the second circuit in accordance with the detection signal.

In the processor, at least part of the logic section preferably stops in accordance with the detection signal.

The processor preferably further includes a latch for holding and outputting the logic level of the detection signal.

The processor preferably further includes a timer for outputting a signal with a given period and the latch is preferably reset by a signal output from the timer.

In the processor, the processor preferably outputs the detection signal to a power-supply circuit for supplying power to the processor, and the processor preferably makes the power-supply circuit stop supplying power to the processor, in accordance with the detection signal.

In the processor, the processor preferably outputs the detection signal to an external clock generator for outputting the clock signal, and the processor preferably makes the external clock generator stop supplying the clock signal to the processor, in accordance with the detection signal.

In the processor, the detection signal is preferably output as a signal for notifying another video signal processor including the external clock generator that both of the processors are connected to each other.

In the processor, when current consumed by the processor is measured and the obtained current value is larger than a given value, the frequency detector preferably outputs the detection signal, assuming that the frequency of the clock signal is higher than the given frequency.

In a second aspect of the present invention, a method for processing a video signal with a video signal processor for processing input video data in accordance with an input clock signal, includes: an input step of changing the format of the video data; a logic step of decoding data obtained in the input step; and a frequency detecting step of detecting that the clock signal has a frequency higher than a given frequency and outputting a result of the detection as a detection signal. When the frequency of the clock signal is higher than the given frequency, operation of at least part of circuits constituting the processor is stopped in accordance with the detection signal.

In a third aspect of the present invention, a display device includes: the video signal processor in the first aspect; a display unit; a display controller for controlling the display unit; and a CPU for controlling the display controller such that when the CPU receives the detection signal, the display unit shows a display indicating that the clock signal has a frequency higher than a given frequency.

In a fourth aspect of the present invention, a display method with a display device including a display unit and a video signal processor for processing input video data in accordance with an input clock signal includes: a frequency detecting step of detecting that the clock signal has a frequency higher than a given frequency; and a control step of showing an display indicating that the frequency of the clock signal is higher than the given frequency when detection is made in the frequency detecting step.

According to the present invention, when a video signal with a high transmission rate is input, operation of at least part of circuits is stopped, thus suppressing generation of excessive heat. Accordingly, a heat sink or the like with high ability is not needed to cope with a case where circuits operate when a video signal with a high transmission rate is input. As a result, cost is reduced.

DESCRIPTION OF THE PREFERRED EMBODIMENTS

Hereinafter, embodiments of the present invention will be described with reference to the drawings.

Embodiment 1

Figure 1:
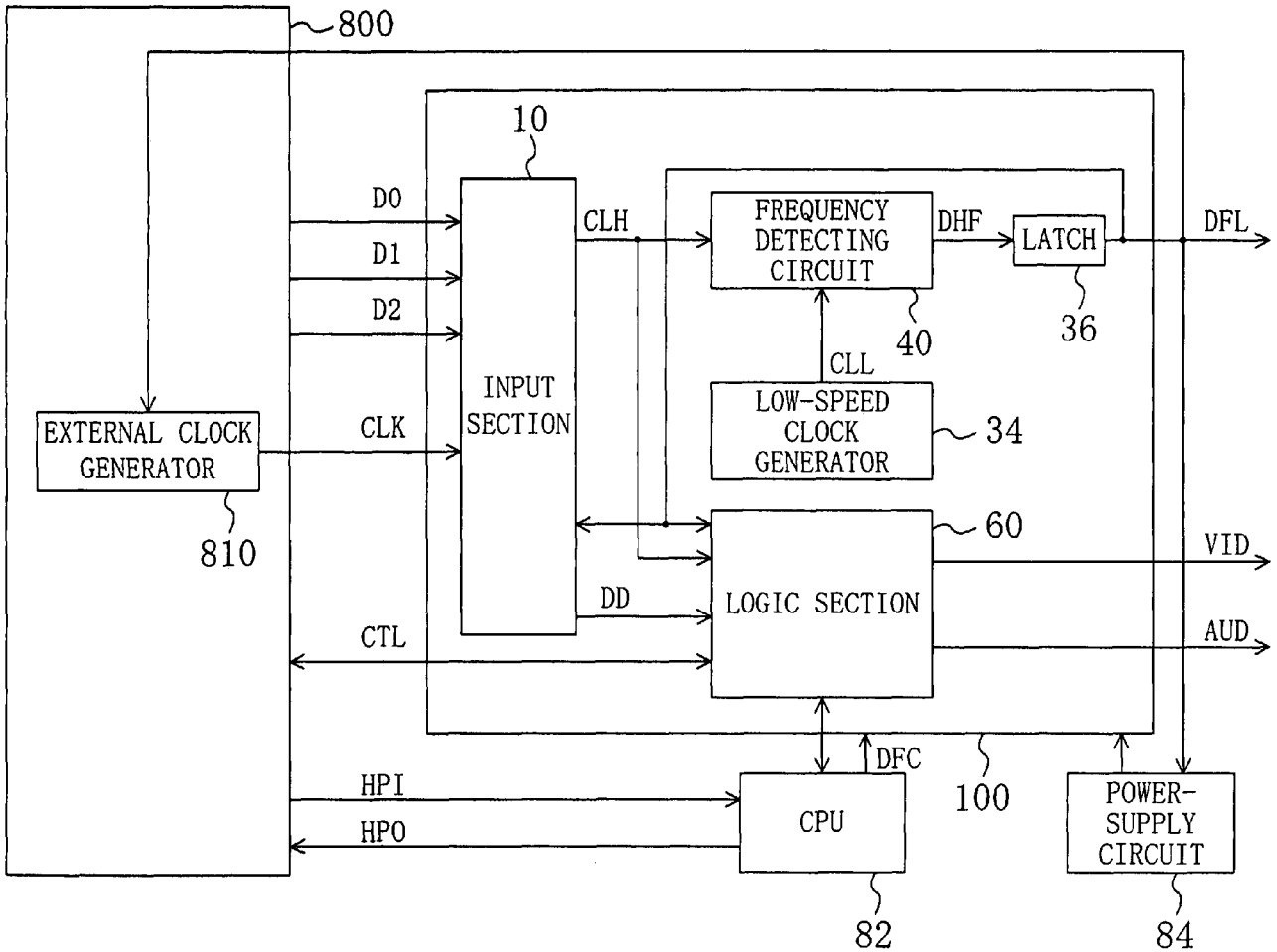
FIG. 1 is a block diagram showing a video signal processor according to a first embodiment of the present invention and its peripheral circuits.

FIG. 1 is a block diagram showing a video signal processor according to a first embodiment of the present invention and its peripheral circuits. A video signal processor 100 shown in FIG. 1 receives, from a video signal processor 800 as a sender, video data D0, D1 and D2 in compliance with the HDMI standard and an external clock signal CLK with a frequency according to the transmission rate of the above video data. The video signal processor 100 transmits and receives a control signal CTL to/from the video signal processor 800.

A central processing unit (CPU) 82 controls the video signal processor 100 as necessary. The CPU 82 receives, from the video signal processor 800, a hot plug detect signal HPI notifying that the video signal processor 800 is connected. The CPU 82 outputs, to the video signal processor 800, a hot plug detect signal HPO notifying that the video signal processor 100 is connected to the video signal processor 800.

The signal transmission and reception between the video signal processor 100 and the video signal processor 800 and between the CPU 82 and the video signal processor 800 as described above is performed via a HDMI connector (not shown.)

The video signal processor 100 outputs a detection signal DFL to an external clock generator 810 generating and outputting an external clock signal CLK and to a power-supply circuit 84. The power-supply circuit 84 supplies power to the video signal processor 100 in accordance with the detection signal DFL.

Figure 2:
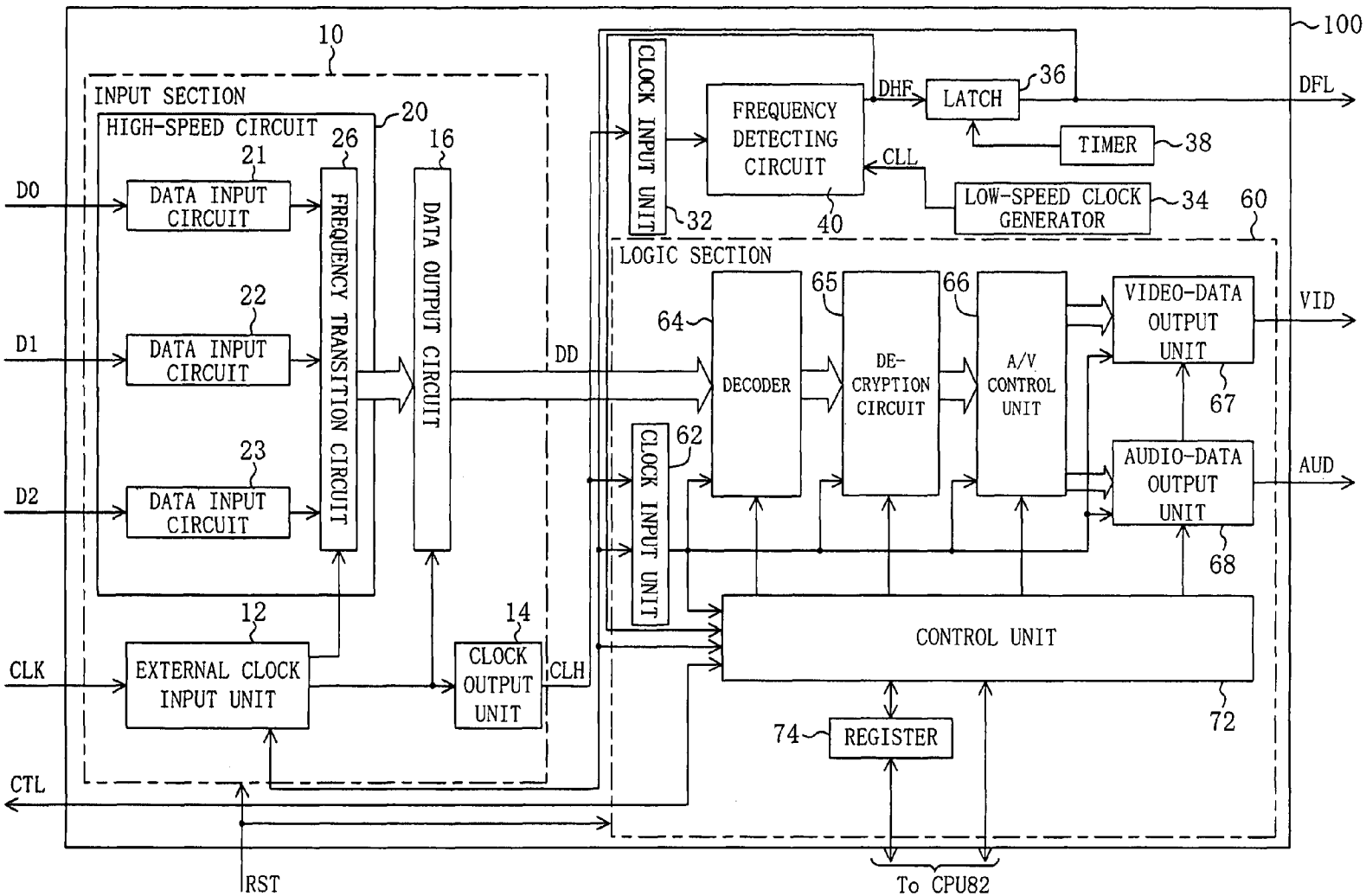
FIG. 2 is a block diagram showing an example of a configuration of the video signal processor shown in FIG. 1.

FIG. 2 is a block diagram showing an example of a configuration of the video signal processor 100 shown in FIG. 1. The video signal processor 100 includes: an input section 10; a clock input unit 32; a low-speed clock generator 34; a latch 36; a timer 38; a frequency detecting circuit 40 as a frequency detector; and a logic section 60.

The input section 10 includes: an external clock input unit 12; a clock output unit 14; a data output circuit 16; and a high-speed circuit 20. The high-speed circuit 20 includes: data input circuits 21, 22 and 23; and a frequency transition circuit 26. The logic section 60 includes: a clock input unit 62; a decoder 64; a decryption circuit 65; an A/V control unit 66; a video-data output unit 67; an audio-data output unit 68; a control unit 72; and a register 74.

Hereinafter, it is assumed that the video signal processor 100 is designed to be operable when the transmission rate of video data D0 through D2 is 750 MHz or less, as an example. The video data D0 through D2 are bit streams with an identical high transmission rate in video transmission. The frequency of the external clock signal CLK is one-tenth of the transmission rate of the video data D0 through D2. For example, when the transmission rate of the video data D0 through D2 is 750 MHz, the frequency of the external clock signal CLK is 75 MHz. Accordingly, if it is detected that the frequency of the external clock signal CLK is higher than a given frequency, it is possible to know that the transmission rate of the video data D0 through D2 is too high.

The video data D0 through D2 are input to the data input circuits 21 through 23, respectively. The data input circuit 21 includes a PLL circuit and makes the PLL circuit into synchronization with the video data D0 so that stabilized video data is output to the frequency transition circuit 26. The data input circuits 22 and 23 are configured in the same manner as the data input circuit 21, and the video data D1 and D2 are stabilized to be output to the frequency transition circuit 26.

The external clock input unit 12 outputs the external clock signal CLK input from the external clock generator 810 to the clock output unit 14, the data output circuit 16 and the frequency transition circuit 26, in accordance with detection signal DFL output from the latch 36. The clock output unit 14 outputs the input clock signal to the clock input units 32 and 62 as a clock signal CLH without change.

The frequency transition circuit 26 converts serial data input from the data input circuits 21 through 23 into parallel data, and outputs the parallel data to the data output circuit 16 in accordance with the timing of the clock signal input from the external clock input unit 12. The data output circuit 16 brings the parallel video data output from the frequency transition circuit 26 into synchronization with the clock signal input from the external clock input unit 12 and outputs the resultant data as video data DD to the decoder 64.

The clock input unit 32 outputs the clock signal CLH to the frequency detecting circuit 40. The low-speed clock generator 34 includes a self-excited oscillator, generates a substantially-periodic low-speed clock signal CLL with a relatively low frequency and outputs the clock signal CLL to the frequency detecting circuit 40. The frequency detecting circuit 40 detects whether or not the frequency of the clock signal CLH is higher than a given frequency using the low-speed clock signal CLL and outputs the result as a detection signal DHF to the latch 36.

When the detection signal DHF transitions to "H", the latch 36 holds this logic level and outputs the logic level as a detection signal DFL to the external clock input unit 12, the clock input unit 62, the control unit 72, the external clock generator 810, the power-supply circuit 84 and other circuits. The timer 38 generates a signal with a given period and outputs the signal to the latch 36. The latch 36 is reset by the signal output from the timer 38.

The clock input unit 62 supplies the clock signal CLH to circuits included in the logic section 60. The decoder 64 decodes the video data DD and outputs the decoded data. The decryption circuit 65 decrypts encrypted data included in the output of the decoder 64 and outputs the decrypted data.

The A/V control unit 66 separates video data from the output of the decryption circuit 65 and outputs the obtained video data to the video-data output unit 67. The A/V control unit 66 also separates audio data from the output and outputs the obtained audio data to the audio-data output unit 68. The video-data output unit 67 outputs video data VID to the outside. The audio-data output unit 68 outputs audio data AUD to the outside. The decoder 64, the decryption circuit 65, the A/V control unit 66, the video-data output unit 67 and the audio-data output unit 68 are controlled by the control unit 72.

The control unit 72 writes a value according to the level of the detection signal DHF output from the frequency detecting circuit 40 in the register 74. The control unit 72 transmits and receives data to/from the CPU 82. The CPU 82 reads and writes data from/in the register 74.

Figure 3:
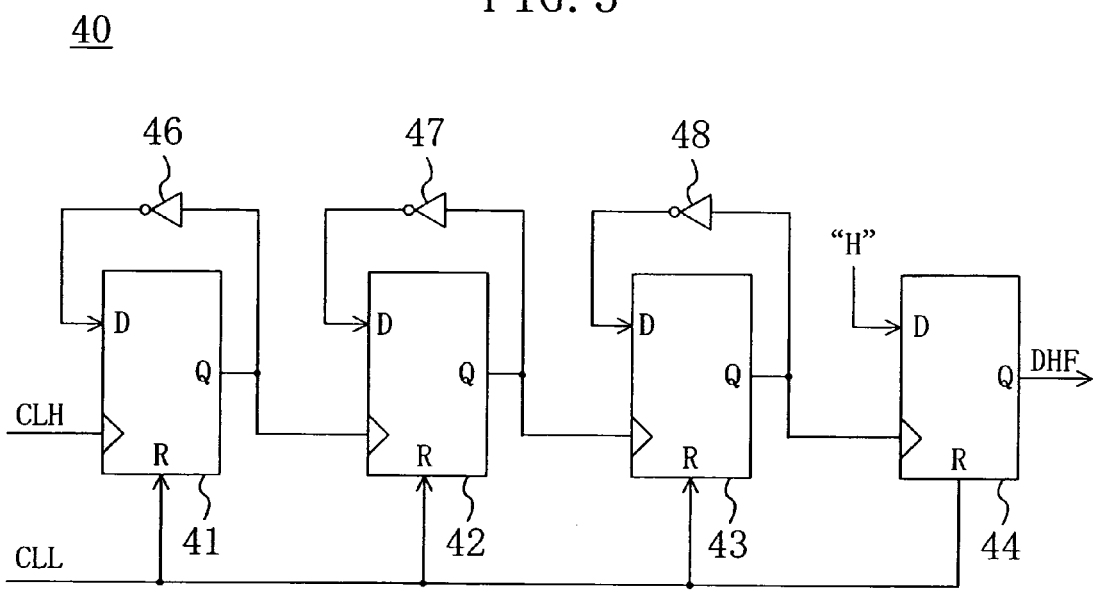
FIG. 3 is a block diagram showing an example of a configuration of a frequency detecting circuit shown in FIG. 2.

FIG. 3 is a block diagram showing an example of a configuration of the frequency detecting circuit 40 shown in FIG. 2. The frequency detecting circuit 40 includes: flip-flops 41, 42, 43 and 44; and inverters 46, 47 and 48. The flip-flops 41 through 43 and the inverters 46 through 48 form a frequency divider for dividing the frequency of the clock signal CLH and outputting the obtained signal. When receiving the low-speed clock signal CLL as a reset signal and then receiving eight pulses of the clock signal CLH, the frequency detecting circuit 40 changes the level of the detection signal DHF from "L" to "H".

Figure 4:
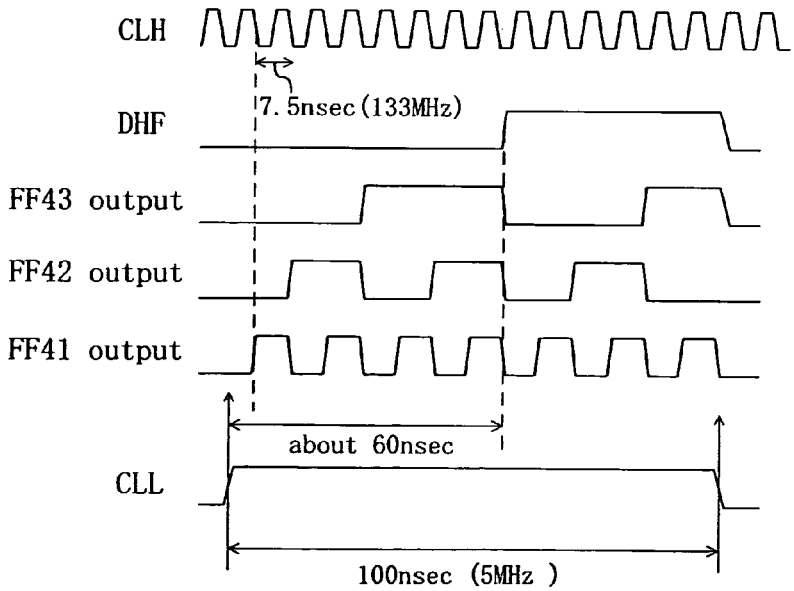
FIG. 4 is a diagram showing examples of signals in the frequency detecting circuit shown in FIG. 3.

FIG. 4 is a diagram showing examples of signals in the frequency detecting circuit 40 shown in FIG. 3. In FIG. 4, the low-speed clock signal CLL has a frequency of 5 MHz and the clock signal CLH as an object to be detected has a frequency of 133 MHz (with a period of 7.5 ns), as an example.

In the case of FIG. 4, the frequency detecting circuit 40 is reset by the low-speed clock signal CLL, causes the detection signal DHF to transition to "H" about 60 ns after the reset, and then detects that a clock signal CLH with a frequency higher than 75 MHz is input, i.e., the frequency of the video data D0 through D2 is higher than a frequency at which data can be processed by the video signal processor 100. On the other hand, if the frequency of the clock signal CLH is 75 MHz (with a period of 13.3 ns), the detection signal DHF does not transition to "H".

The data input circuits 21 through 23 and the frequency transition circuit 26 operate at the frequency of input video data. The external clock input unit 12 and the data output circuit 16 operate at the frequency of the external clock signal CLK.

When the detection signal DFL indicates that the frequency of the external clock signal CLK is higher than, for example, 75 MHz, the external clock input unit 12 stops high-speed operation of the data input circuits 21 through 23 and of the frequency transition circuit 26 by stopping the supply of a clock signal.

In this case, the external clock input unit 12 may stop operation of relatively-low-speed operation of the data output circuit 16 by stopping the supply of a clock signal or by stopping operation of itself.

Alternatively, the clock input unit 62 may stop at least part of circuits constituting the logic section 60, e.g., the decoder 64, the decryption circuit 65, the A/V control unit 66, the video-data output unit 67, the audio-data output unit 68 or the control unit 72 by stopping the supply of a clock signal.

Alternatively, the clock output unit 14 may stop the supply of a clock signal to the clock input units 32 and 62 to stop operation of the frequency detecting circuit 40 and the logic section 60.

Alternatively, the power-supply circuit 84 may stop power supply to the video signal processor 100.

Alternatively, the external clock generator 810 may stop outputting the external clock signal CLK.

The detection signal DFL may be used as a reset signal RST to stop operation of the entire video signal processor 100.

The CPU 82 or the control unit 72 may output the detection signal DFL as a hot plug detect signal HPO. Specifically, when the frequency of the external clock signal CLK is higher than a given frequency, a hot plug detect signal HPO indicating that the video signal processor 100 is not connected to the video signal processor 800 may be output. Then, the video signal processor 800 is able to stop outputting the video data D0 through D2 and the external clock signal CLK.

The frequency detecting circuit 40 may measure current consumed by the video signal processor 100. In this case, if the obtained current value is larger than a given value, the frequency of the external clock signal CLK is assumed to be higher than a given frequency, so that a detection signal indicating detection of a clock signal with a high frequency is output.

Instead of the detection signal DFL, the detection signal DHF output from the frequency detecting circuit 40 may be used. In this case, the latch 36 and the timer 38 may be omitted.

Modified Example 1

As a first modified example of the first embodiment, an example in which an input of a clock signal with a high frequency is detected will be described. In this modified example, the frequency detecting circuit and the CPU form a frequency detector.

The CPU 82 receives an output from a frequency divider via the control unit 72, detects that the frequency of the external clock signal CLK is higher than a given frequency based on the interval between changes in the level of this output, and outputs the result of the detection as a detection signal DFC. As the detection signal DFL shown in FIG. 2, the detection signal DFC can be used for control of circuits in the video signal processor.

For example, if a frequency divider in which 25 stages of flip-flops are connected in series is used as a frequency detecting circuit, the period of an output from the frequency divider is about 252 ms and about 447 ms in cases where the frequency of the external clock signal CLK is 133 MHz and 75 MHz, respectively. The CPU 82 detects the level of an output from the frequency divider every 50 ms, and detects whether or not the frequency of the external clock signal CLK is higher than a given frequency based on the number of successive occurrences of the same level.

Since the control unit 72 writes a value according to the level of the detection signal DHF in the register 74, the CPU 82 may read data from the register 74 to detect the frequency of the external clock signal CLK.

The input section 10, the high-speed circuit 20 and the external clock input unit 12, for example, may be associated with the least significant bit, the second-least significant bit and the third-least significant bit, respectively, in the register 74 as circuit blocks. In addition, the control unit 72 may store outputs of some of the flip-flops constituting the frequency divider in respective different bits in the register 74 so that the CPU 82 controls operation such as operation of stopping each of the input section 10, the high-speed circuit 20 and the external clock input unit 12 based on the value of an associated one of the bits in the register 74. Then reduction of power consumption necessary for a system is easily controlled by the CPU 82.

Modified Example 2

Figure 5:
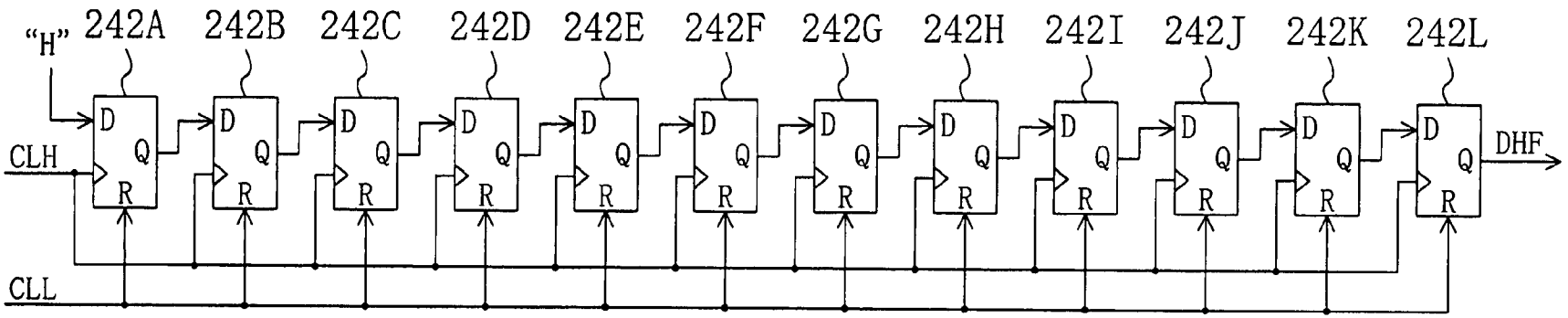
FIG. 5 is a block diagram showing another example of the configuration of the frequency detecting circuit shown in FIG. 2.

FIG. 5 is a block diagram showing another example of the configuration of the frequency detecting circuit shown in FIG. 2. The frequency detecting circuit (frequency detector) shown in FIG. 5 includes flip-flops 242A, 242B, 242C, 242D, 242E, 242F, 242G, 242H, 242I, 242J, 242K and 242L. These flip-flops 242A through 242L are connected in series such that the output of each flip-flop serves as an input signal to the flip-flop at the following stage, thereby forming a shift circuit. When receiving the low-speed clock signal CLL as a reset signal and then receiving twelve pulses of the clock signal CLH, the frequency detecting circuit shown in FIG. 5 changes the level of the detection signal DHF from "L" to "H".

Figure 6:
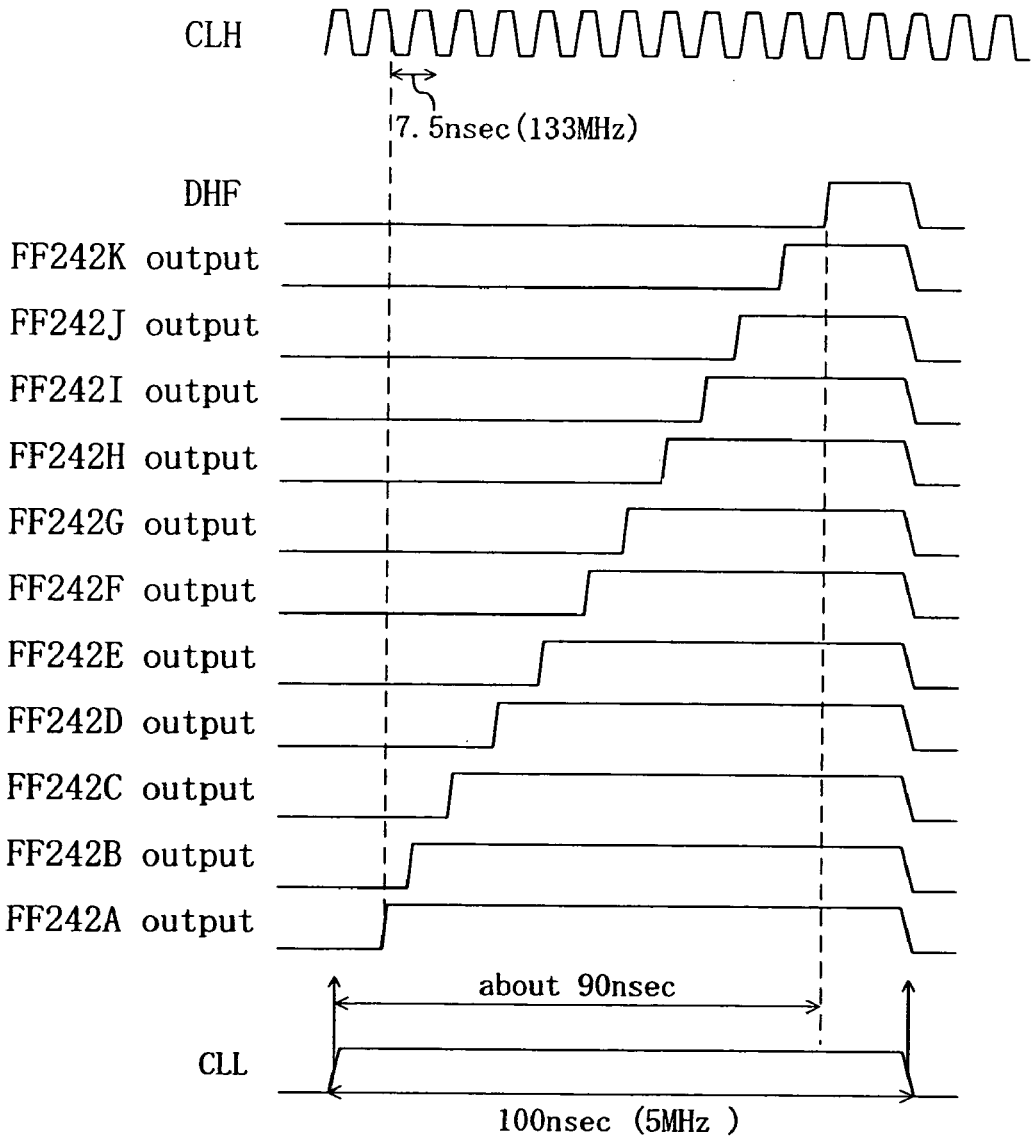
FIG. 6 is a diagram showing examples of signals in the frequency detecting circuit shown in FIG. 5.

FIG. 6 is a diagram showing examples of signals in the frequency detecting circuit shown in FIG. 5. In FIG. 6, it is also assumed that the frequency of the low-speed clock signal CLL is 5 MHz and the frequency of the clock signal CLH as an object to be detected is 133 MHz (with a period of 7.5 ns), as an example.

In the case of FIG. 6, the frequency detecting circuit is reset by the low-speed clock signal CLL, causes the detection signal DHF to transition to "H" about 90 nsec after the reset, and then detects that a clock signal CLH with a frequency higher than 75 MHz is input. On the other hand, if the frequency of the clock signal CLH is 75 MHz (with a period of 13.3 ns), the detection signal DHF does not transition to "H".

Modified Example 3

Figure 7:
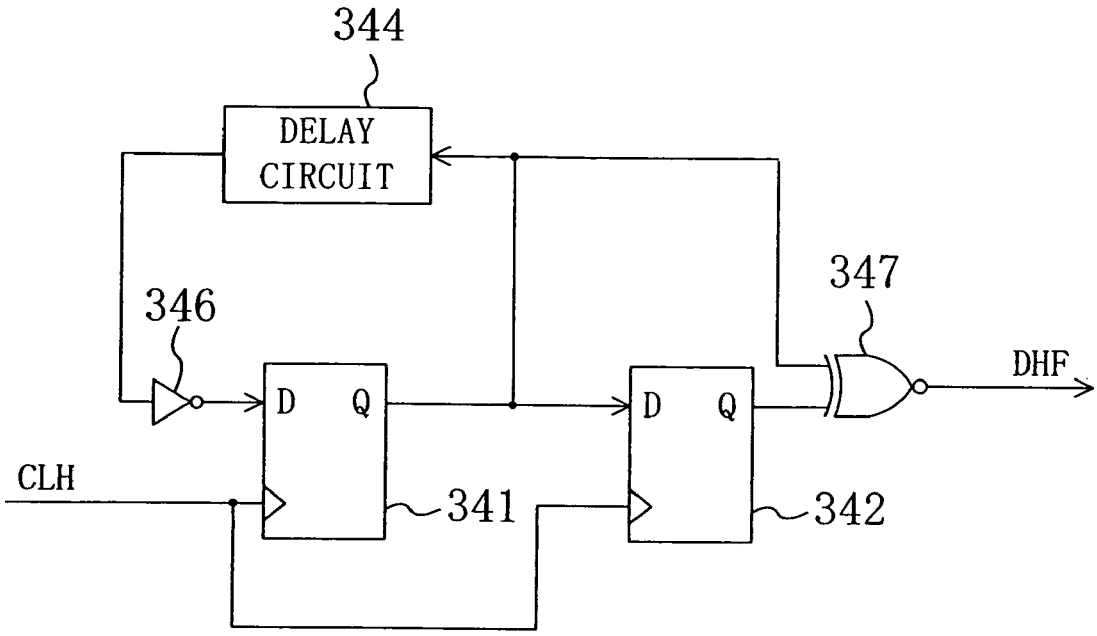
FIG. 7 is a block diagram showing another example of the configuration of the frequency detecting circuit shown in FIG. 2.

FIG. 7 is a block diagram showing another example of the configuration of the frequency detecting circuit shown in FIG. 2. The frequency detecting circuit (frequency detector) shown in FIG. 7 includes: flip-flops 341 and 342; a delay circuit 344; an inverter 346; and an exclusive-OR gate 347. In this example, the low-speed clock generator 34 is not needed.

The delay circuit 344 delays an output of the flip-flop 341 and produces an output to the inverter 346. The inverter 346 inverts the logic level of the output of the delay circuit 344 and produces an output to the flip-flop 341. The flip-flop 341 brings the output of the inverter 346 into synchronization with the clock signal CLH and outputs the result. The flip-flop 342 receives the output of the flip-flop 341 and outputs the received output to the exclusive-OR gate 347 in synchronization with the clock signal CLH. The exclusive-OR gate 347 obtains the exclusive-OR of the output from the flip-flops 341 and 342, and outputs the result as a detection signal DHF.

The delay generated by the delay circuit 344 is set longer than a period of a clock signal at 133 MHz and shorter than a period of a clock signal at 75 MHz, for example. Then, the exclusive-OR gate 347 outputs a signal which repeatedly transitions between "H" and "L" when a high-speed clock signal at 133 MHz is input as the clock signal CLH and outputs a signal whose level does not change when a low-speed clock signal at 75 MHz is input. Accordingly, the frequency detecting circuit shown in FIG. 7 is able to detect an input of a high-speed clock signal.

Embodiment 2

Figure 8:
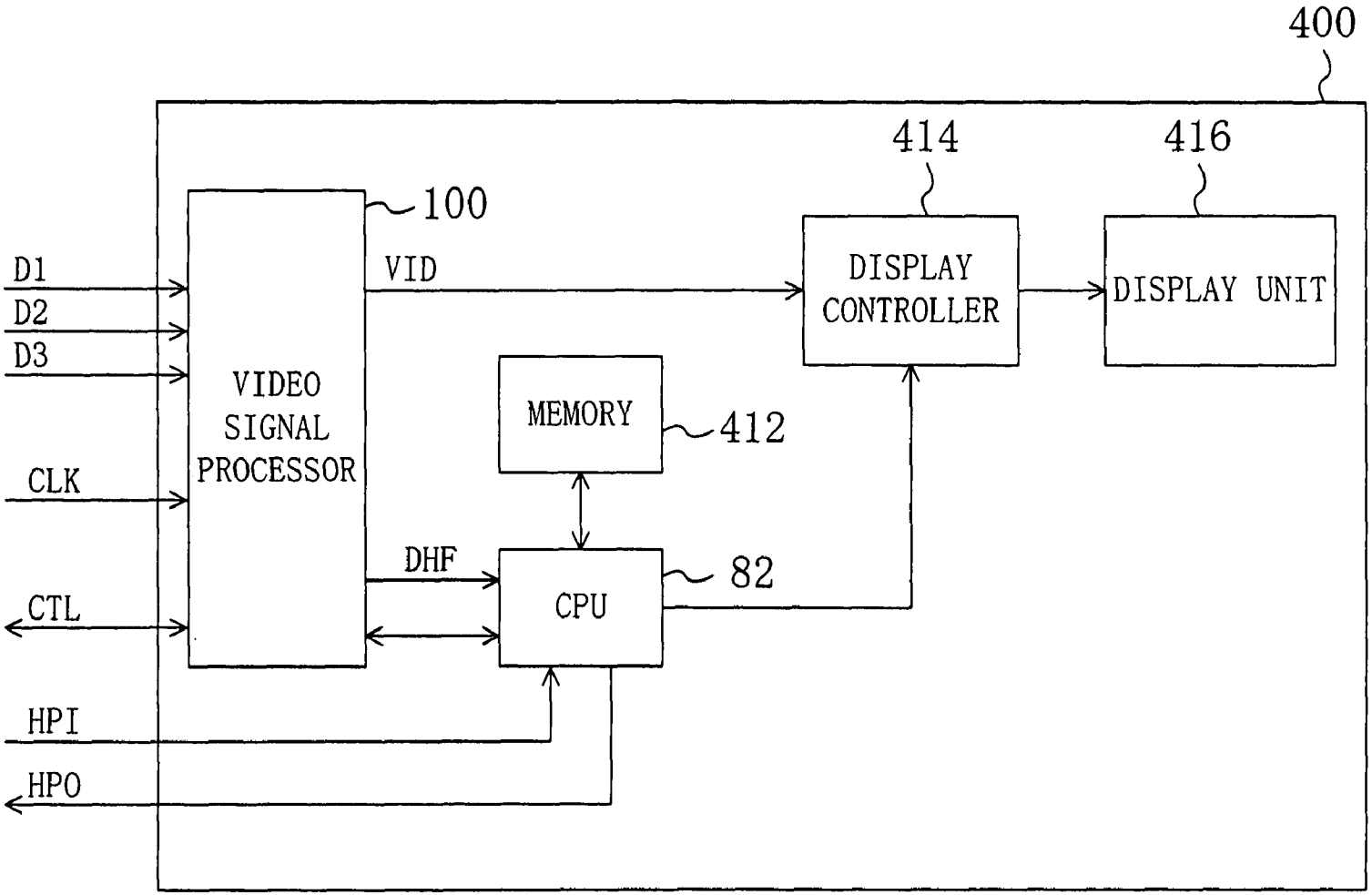
FIG. 8 is a block diagram showing an example of a configuration of a display device using the video signal processor shown in FIG. 2.

FIG. 8 is a block diagram showing an example of a configuration of a display device using the video signal processor shown in FIG. 2. A display device 400 shown in FIG. 8 includes: a video signal processor 100: a CPU 82; a memory 412; a display controller 414; and a display unit 416.

The video signal processor 100 outputs video data VID to the display controller 414 and a detection signal DHF to the CPU 82. When the detection signal DHF indicates detection of a high-frequency signal, the CPU 82 controls the display controller 414 such that data previously stored in the memory 412 is read out to be displayed by the display unit 416. The display controller 414 outputs the video data VID or data read out from the memory 412 by the CPU 82 to the display unit 416 and makes the data displayed, in accordance with an instruction of the CPU 82.

When the detection signal DHF indicates detection of a high-frequency signal, the CPU 82 makes the display unit 416 show a display indicating that, for example, the frequency of an external clock signal CLK is higher than a given frequency, i.e., the transmission rate of video data D0 through D2 input to the video signal processor 100 is higher than a given transmission rate, or a cable through which the video data D0 through D2 are transmitted needs to be removed from the display device 400.

Even if video data with an excessively high transmission rate is input and thereby the data fails to be displayed, the display device 400 enables a user to easily know a cause of the failure, so that measures such as disconnecting the cable in use and using another can be taken.

As described above, the present invention is useful for a video signal processor because generation of excessive heat is suppressed in a case where a video signal with a high transmission rate is input.

What is claimed is:

1. A video signal processor for processing input video data in accordance with an input clock signal, the processor comprising:

an input section configured to change the format of the video data and outputting resultant data;

a logic section configured to decode the data output from the input section and outputting decoded data; and a frequency detector configured to detect that the clock signal has a frequency higher than a given frequency and outputting a result of the detection as a detection signal, wherein when the frequency of the clock signal is higher than the given frequency, the detection signal controls the video signal processor to terminate an operation of at least part of circuits forming the video signal processor.

2. The processor of claim 1, further comprising a low-speed clock generator for outputting a substantially-periodical signal, wherein the frequency detector includes a frequency divider using the signal output from the low-speed clock generator as a reset signal, dividing the frequency of the clock signal and outputting a resultant signal as the detection signal.

3. The processor of claim 1, further comprising a low-speed clock generator for outputting a substantially-periodical signal, wherein the frequency detector includes a shift circuit using the signal output from the low-speed clock generator as a reset signal and outputting, as the detection signal, a result obtained by shifting a signal at a given level in accordance with the clock signal.

4. The processor of claim 1, wherein the frequency detector includes:

a frequency divider for dividing the frequency of the clock signal and outputting a resultant signal; and a central processing unit (CPU) for performing the detection based on an interval between changes in the level of the signal output from the frequency divider and outputting a result of the detection as the detection signal.

5. The processor of claim 4, wherein the frequency detector further includes a register for holding and outputting the output of the frequency divider, and the CPU performs the detection using an output of the register.

6. The processor of claim 5, wherein the input section and the logic section include blocks associated with respective bits in the register, the frequency divider outputs a plurality of signals obtained by dividing the frequency of the clock signal by different ratios, the register stores the signals output from the frequency divider in respective different bits, and the CPU controls operation of each of the blocks based on the value of an associated one of the bits in the register.

7. The processor of claim 1, wherein the frequency detector includes:

an inverter for inverting the logic level of an input signal and producing an output;

a first flip-flop for outputting the output of the inverter in synchronization with the clock signal;

a delay circuit for delaying the output of the first flip-flop and outputting a delayed signal to the inverter;

a second flip-flop for outputting the output of the first flip-flop in synchronization with the clock signal; and an exclusive-OR gate for obtaining an exclusive-OR of the output from the first and second flip-flops and outputting the obtained exclusive-OR as the detection signal.

8. The processor of claim 1, wherein the input section includes:

a first input circuit operating at the frequency of the input video data; and a second circuit operating at the frequency of the clock signal, wherein the input section stops the first circuit in accordance with the detection signal.

9. The processor of claim 8, wherein the input section stops the second circuit in accordance with the detection signal.

10. The processor of claim 1, wherein at least part of the logic section stops in accordance with the detection signal.

11. The processor of claim 1, further comprising a latch for holding and outputting the logic level of the detection signal.

12. The processor of claim 11, further comprising a timer for outputting a signal with a given period, wherein the latch is reset by a signal output from the timer.

13. The processor of claim 1, wherein the processor outputs the detection signal to a power-supply circuit for supplying power to the processor, and the processor makes the power-supply circuit stop supplying power to the processor, in accordance with the detection signal.

14. The processor of claim 1, wherein the processor outputs the detection signal to an external clock generator for outputting the clock signal, and the processor makes the external clock generator stop supplying the clock signal to the processor, in accordance with the detection signal.

15. The processor of claim 14, wherein the detection signal is output as a signal for notifying another video signal processor including the external clock generator that both of the processors are connected to each other.

16. The processor of claim 1, wherein when current consumed by the processor is measured and the obtained current value is larger than a given value, the frequency detector outputs the detection signal, assuming that the frequency of the clock signal is higher than the given frequency.

17. A method for processing a video signal with a video signal processor for processing input video data in accordance with an input clock signal, the method comprising:

an input step of changing the format of the video data;

a logic step of decoding data obtained in the input step; and a frequency detecting step of detecting that the clock signal has a frequency higher than a given frequency and outputting a result of the detection as a detection signal, wherein when the frequency of the clock signal is higher than the given frequency, the detection signal controls the video signal processor to terminate an operation of at least part of circuits forming the video signal processor.

18. A display device, comprising:

the video signal processor of claim 1;

a display unit;

a display controller for controlling the display unit; and a CPU for controlling the display controller such that when the CPU receives the detection signal, the display unit shows a display indicating that the clock signal has a frequency higher than a given frequency.

* * * * *

UNITED STATES PATENT AND TRADEMARK OFFICE

CERTIFICATE OF CORRECTION

PATENT NO. : 7,864,252 B2
APPLICATION NO. : 11/071190
DATED : January 4, 2011
INVENTOR(S) : Satoshi Takahashi et al.

It is certified that error appears in the above-identified patent and that said Letters Patent is hereby corrected as shown below:

On the Title Page:

Item "(56) References Cited", under "FOREIGN PATENT DOCUMENTS", col. 2, change "JP 2001-266313" to --JP 2001-265313--.

Signed and Sealed this
Eighth Day of March, 2011

David J. Kappos

David J. Kappos
*Director of the United States Patent and Trademark Office*